US006277537B1

(12) United States Patent
Bailey et al.

(10) Patent No.: US 6,277,537 B1
(45) **Date of Patent: *Aug. 21, 2001**

(54) DYE DIFFUSION IMAGE SEPARATION SYSTEMS WITH THERMAL SOLVENTS

(75) Inventors: David Scott Bailey; Ronald Henry White; John Texter, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 07/804,868

(22) Filed: Dec. 6, 1991

(51) Int. Cl.[7] ..... G03C 8/48; G03C 8/20

(52) U.S. Cl. ..... 430/203; 430/226; 430/223; 430/618; 430/699

(58) Field of Search ..... 430/203, 617, 430/618, 619, 223, 226, 372

(56) References Cited

U.S. PATENT DOCUMENTS

T867,007 * 10/1969 Baxendule et al. ..... 430/617

(List continued on next page.)

FOREIGN PATENT DOCUMENTS

0119615 * 9/1984 (EP) ..... 430/203
276 319 8/1988 (EP) .
60 14241 * 1/1985 (JP) ..... 430/203
62-25754 2/1987 (JP) .
62136445 * 6/1987 (JP) ..... 430/617

*Primary Examiner*—Martin Angebranndt
(74) *Attorney, Agent, or Firm*—Paul A. Leipold

(57) ABSTRACT

A photographic chrogenic and substantially dry dye-diffusion-transfer element is disclosed, wherein said element is activated by heat and comprises contacting dye-receiver and dye-donor layers and further comprises a layer which contains a thermal solvent according to formula (I)

(I)

wherein $Z_1$, $Z_2$, $Z_3$, $Z_4$, and $Z_5$ are substituents, the Hammet sigma paameters of $Z_2$, $Z_3$, and $Z_4$ sum to at least −0.28 and less than 1.53;

the calculated logP for I is greater than 3 and less than 10.

35 Claims, 1 Drawing Sheet

U.S. PATENT DOCUMENTS

| | | | | |
|---|---|---|---|---|
| 2,835,579 | | 5/1958 | Thirtle et al. | 430/546 |
| 3,227,550 | * | 1/1966 | Whitmore et al. | 430/226 |
| 3,347,675 | | 10/1967 | Henn et al. | 430/617 |
| 3,438,776 | | 4/1969 | Yudelson | 430/617 |
| 3,457,075 | | 7/1969 | Morgan et al. | 430/353 |
| 3,649,280 | * | 3/1972 | King et al. | 430/617 |
| 3,667,959 | | 6/1972 | Bojara et al. | 430/617 |
| 3,998,637 | * | 12/1976 | Faul et al. | 430/223 |
| 4,168,980 | | 9/1979 | LaRossa | 430/203 |
| 4,228,235 | * | 10/1980 | Okonogi et al. | 430/372 |
| 4,358,526 | * | 11/1982 | Fujita et al. | 430/226 |
| 4,374,921 | * | 2/1983 | Frenchik | 430/617 |
| 4,474,574 | * | 10/1984 | Hirano et al. | 430/372 |
| 4,536,467 | * | 8/1985 | Sakaguchi et al. | 430/617 |
| 4,551,422 | | 11/1985 | Kimura et al. | 430/546 |
| 4,555,470 | * | 11/1985 | Sakaguchi et al. | 430/617 |
| 4,584,267 | | 4/1986 | Masukawa et al. | 430/619 |
| 4,590,154 | | 5/1986 | Hirai et al. | 430/203 |
| 4,594,308 | * | 6/1986 | Nakamura et al. | 430/213 |
| 4,626,494 | * | 12/1986 | Waki et al. | 430/213 |
| 4,770,981 | | 9/1988 | Komamura et al. | 430/203 |
| 4,770,989 | * | 9/1988 | Komamura et al. | 43/351 |
| 4,774,166 | | 9/1988 | Sakai et al. | 430/386 |
| 4,948,698 | | 8/1990 | Komamura | 430/203 |
| 4,952,479 | | 8/1990 | Aono et al. | 430/203 |
| 4,983,502 | | 1/1991 | Ohbayashi et al. | 430/203 |
| 5,008,179 | * | 4/1991 | Chari et al. | 430/546 |
| 5,017,454 | | 5/1991 | Nakamine et al. | 430/203 |
| 5,032,499 | * | 7/1991 | Kohno et al. | 430/203 |
| 5,064,742 | | 11/1991 | Aonon et al. | 430/203 |
| 5,064,753 | * | 11/1991 | Sohei et al. | 430/617 |
| 5,169,742 | * | 12/1992 | Takahashi et al. | 430/372 |
| 5,264,332 | * | 11/1993 | Otani et al. | 430/372 |
| 5,360,695 | * | 11/1994 | Texter | 430/203 |

* cited by examiner

DYE DIFFUSION IMAGE SEPARATION SYSTEMS WITH THERMAL SOLVENTS

TECHNICAL FIELD

This invention relates to chromogenic photographic imaging systems that utilize silver halide based rdiation sensitive layers and associated formation of image dyes. In particular, this invention relates to such systems where the resulting dye images, when the photographic elements are substantially dry, are transferred to a polymeric receiver layer, thereby separating the developed silver and dye images.

BACKGROUND ART

Thernal Solvents in Dry Phototherrnographic Systems

Heat processable photosensitive elements can be constructed so that after exposure, they can be processed in a substantially dry state by applying heat. It is known how to develop latent image in a photographic element not containing silver halide wherein organic silver salts are used as a source of silver for image formation and amplification. Such processes are described in U.S. Pat. No. 3,429,706 (Shepard et al.) and U.S. Pat. No. 3,442,682 (Fukawa et al.). Other dry processing thermographic systems are described in U.S. Pat. No. 3,152,904 (Sorenson et al.) and U.S. Pat. No. 3,457,075 (Morgan and Shely). A variety of compounds have been proposed as "carriers" or "thermal solvents" or "heat solvents" for such systems, whereby these additives serve as solvents for incorporated developing agents, or otherwise facilitate the resulting development or silver diffusion processes. Acid amides and carbamates have been proposed as such thermal solvents by Henn and Miller (U.S. Pat. No. 3,347,675) and by Yudelson (U.S. Pat. No. 3,438,776). Bojara and de Mauriac (U.S. Pat. No. 3,667,959) disclose the use of nonaqueous polar solvents containing thione, —$SO_2$— and —CO— groups as thermal solvents and carriers in such photographic elements. Similarly, La Rossa (U.S. Pat. No. 4,168,980) discloses the use of imidazoline-2-thiones as processing addenda in heat developable photographic materials.

Thermal solvents for use in substantially dry color photothermographic systems have been disclosed by Komamura et al. (U.S. Pat. No. 4,770,981), Komamura (U.S. Pat. No. 4,948,698), Aomo and Nakamaura (U.S. Pat. No. 4,952,479), and Ohbayashi et al. U.S. Pat. No. 4,983,502). The terms "heat solvent" and "thermal solvent" in these disclosures refer to a non-hydrolyzable organic material which is a liquid at ambient temperature or a solid at an ambient temperature but melts together with other components at a temperature of heat treatment or below but higher than 40° C. Such solvents may also be solids at temperatures above the thermal processing temperature. Their preferred examples include compounds which can act as a solvent for the developing agent and compounds having a high dielectric constant which accelerate physical development of silver salts. Alkyl and aryl amides are disclosed as "heat solvents" by Komamura et al. (U.S. Pat. No. 4,770,981), and a variety of benzamides have been disclosed as "heat solvents" by Ohbayashi et al. (U.S. Pat. No. 4,983,502). Polyglycols, derivatives of polyethylene oxides, beeswax, monostearin, high dielectric constant compounds having an —$SO_2$— or —CO— group such as acetamide, ethylcarbamate, urea, methylsulfonamide, polar substances described in U.S. Pat. No. 3,667,959, lactone of 4-hydroxybutanoic acid, methyl anisate, and related compounds are disclosed as thermal solvents in such systems. The role of thermal solvents in these systems is not clear, but it is believed that such thermal solvents promote the diffusion of reactants at the time of thermal development. Masukawa and Koshizuka disclose (U.S. Pat. No. 4,584,267) the use of similar components (such as methyl anisate) as "heat fusers" in thermally developable light-sensitive materials.

Other Heat Developable Thermal Diffision Transer Systems

Hirai et al. (U.S. Pat No. 4,590,154) disclose a heat developable color photographic light-sensitive material comprising silver halide, a hydrophilic binder, dye releasing compounds which release mobile dyes, and a sulfonamide compound. This system requires only heat to develop the latent image and to produce mobile dyes. However, the mobile dyes are affixed to an image receiving material, which must be wetted with water prior to being contacted with the heat developed donor element. The subsequent dye diffusion transfer to the receiver element is therefore of the conventional wet diffusion type.

Nakamine et al. (U.S. Pat. No. 5,107,454) disclose a heat developable photographic chromogenic system that also utilizes diffusion transfer of dyes to an image receiving (fixing) element. The dye diffusion transfer in actuality requires that the image receiving or fixing element be wetted with water prior to being affixed to the dye donor element. The resulting dye transfer, therefore, is a wet diffusion transfer of the conventional type, not dry thermal dye transfer.

Physical Organic Characterization of Thermal Solvents

Materials can be described by a variety of extrathermodynanic properties and parameters to relate their activity, according to some performance measure, to their structure. One of the best known of such classifications is the Hammett substituent constant, as described by L. P. Hammett in *Physical Organic Chemistry* (McGraw-Hill Book Company, New York, 1940) and in other organic text books, monographs, and review articles. These parameters, which characterize the ability of meta and para ring-substituents to affect the electronic nature of a reaction site, were originally quantified by their effect on the $pK_a$ of benzoic acid. Subsequent work has extended and refined the original concept and data, but for the purposes of prediction and correlation, standard sets of such constants, $\sigma_{meta}$ and $\sigma_{para}$, are widely available in the chemical literature, as for example in C. Hansch et al., *J. Med. Chem.*, 17, 1207 (1973).

Another parareter of significant utility relates to the variation in the partition coefficient of a molecule between octanol and water. This is the so-called logP parameter, for the logarithm of the partition coefficient. The corresponding substituent or fragment parameter is the Pi parameter. These parameters are described by C. Hansch and A. Leo in *Substituent Constantsfor Correlation Analysis in Chemistry and Biology* (John Wiley & Sons, New York, 1969). Calculated logP (often termed cLogP) values are calculated by fragment additivity treatments with the aid of tables of substituent Pi values, or by use of expert programs that calculate octanol/water partition coefficients based on more sophisticated treaments of measured fragment values. An example of the latter is the widely used computer program, *MedChem Software* (Release 3.54, August 1991, Medicinal Chemistry Project, Pomona College, Claremont, Calif.).

The use of these parameters allows one to make quantitative predictions of the performance of a given molecule, and in the present invention, of a given thermal solvent candidate. The Hainnett parameters are routinely sumrned, to give a net electronic effect Σ, where Σ is the sum of the respective substituent $\sigma_{meta}$ and $\sigma_{para}$ values. Substituent and fragment parameters are readily available, so that logP and Σ estimates may be easily made for any prospective molecule of interest.

Problems in the Prior Art

A major problem that remains in such wet developed systems, wherein the dye images so formed are transferred by diffusion through substantially dry gelatin, is to facilitate the ease with which such dye images may be transferred by diffusion. Another problem that exists is to facilitate such diffusion without inducing the crystallization of said dyes in the gelatin binder. Similar problems of dry dye diffusion transfer exist in color photothermographic systems that rely on dry development processes.

Much of the aforementioned prior art having to do with chromogenic image formation in diffusion transfer processes actually utilize a considerable amount of water in the diffusion process. The diffusion therefore is conventional diffusion transfer, rather than the extremely highly activated diffusion of said dyes through substantially dry gelatin. Diffusion of dyes through wet gelatin, when such dyes have sufficient solubilization, is relatively facile. Much of this same prior art, based on moderately wet diffusion transfer, utilizes imaging chemistry, (dye releasing compounds), that is much more expensive than the simple silver halide based indoaniline dye forrming chemistry obtained in conventional wet development of silver halide systems.

These and other problems may be overcome by the practice of our invention.

DISCLOSURE OF INVENTION

An object of the present invention is to provide a chromogenic heat processable photographic material with a high density and low fog image. A further object of the present invention is to provide improved image dye diffusion transfer efficiency.

A further object of the present invention is to allow separation of the silver, silver halide, and unused chromogenic chemistry from the dye image. Another object of the present invention is to provide a chromogenic imaging system wherein much of the chemistry utilized in creating the image is recoverable and recyclable. Yet another object of the present invention is to provide an imaging system which minimizes toxic effluent and environmental contamination.

The present inventors have conducted exhaustive experimental investigations into the behavior of hundreds of fine organic chemicals, and their impact on mediating the thermal diffusion of photographic image dyes through hydrophilic binders in photographic elements. We have discovered that substituted phenols serve to advantageously improve the diffusion of image dyes through relatively dry photographic binders such as gelatin to a receiver element. This improved diffusion results in enhanced image dye densities in the receiver layer. These advantageous materials may be described by the general structure (I)

(I)

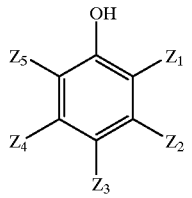

wherein $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

the calculated logP for I is greater than 3 and less than 10.

These thermal solvents are incorporated in layers in the photographic element using methods well known in the art.

DETAILED DESCRIPTION OF THE INVENTION

Compositions of the present invention yield dramatically improved dye images in receiver layers of the photographic element. This improved dye transfer efficiency enables photographic elements to be constructed using less incorporated chemistry and therefore lower manufacturing costs.

Figure 1:
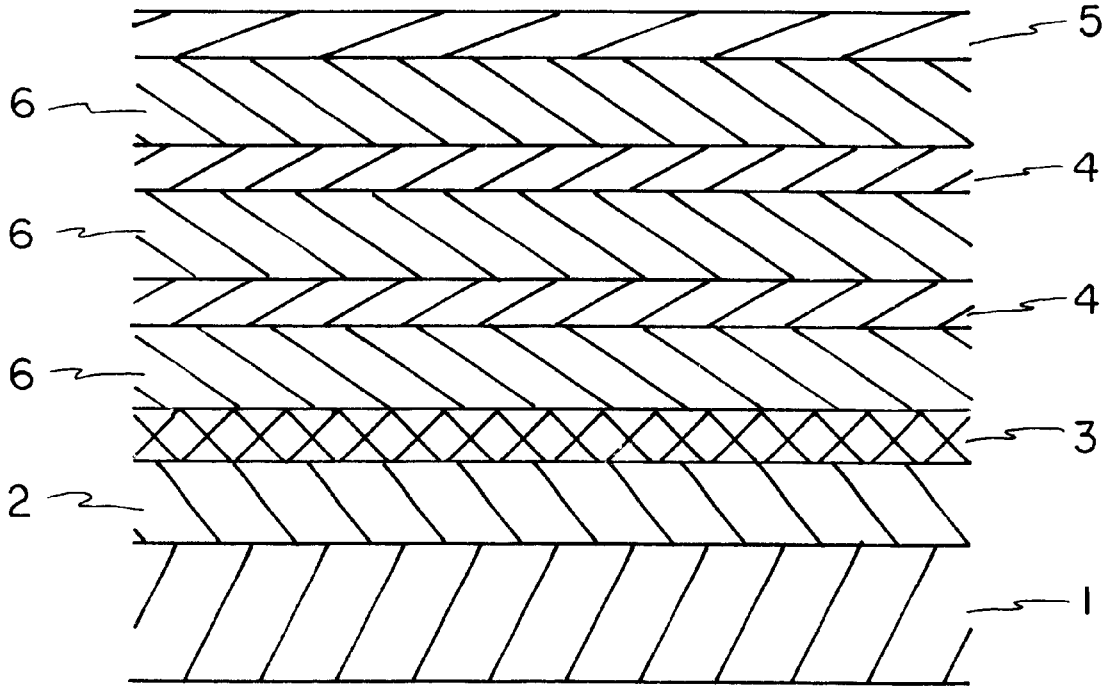
FIG. 1. Photographic element layer-structure for heat image separation system: 1—transparent or reflection base; 2—polymeric receiving layer, 3—stripping layer (optional); 4—interlayers; 5—protective overcoat layer; 6—diffusion transfer dye generation layers. The number of dye generation layers (6) is greater than or equal to one. Interlayers (4) between dye generation layers (6) are optional.

A novel method of imaging, whereby conventional wet development processes are utilized in combination with substantially dry thermally activated diffusion transfer of image dyes to a polymeric receiver has been described by Willis and Texter concurrently filed herewith now U.S. application Ser. No. 07/804,877 filed Dec. 6, 1992 and hereby incorporated by reference. The methods and processes disclosed there are incorporated herein by reference. The essential morphology of such an imaging system is illustrated in FIG. 1. It essentially consists of a conventional multilayer photographic element coated on a polymeric receiver element The conventional element comprises one or more dye generation layers (6) and optionally one or more interlayers (4) and a protective overcoat (5) layer. This multilayer structure is coated on a receiver layer (2) with an optionally intervening stripping layer (3). The receiver layer (2) is coated on an appropriate transparent or reflection base (1). Images are created by conventional radiation sensitivities in the silver halide emulsion containing layers, and these images are amplified using conventional aqueous color development processes. After the development, the development is stopped with an appropriate stop bath, and thereafter the element is dried. No fixing or bleaching chemistry need be invoked in this process. After the elements have been dried, they are subjected to heating, in order to drive the image dyes to the receiver layer. After such image transfer, the donor layers are removed and recycled, to recover silver and valuable fine organic compounds, and the receiver/base combination is retained as the final print material Texter et al. in U.S. application Ser. No. 07/805,717, now U.S. Pat. No. 5,164,280, hereby incorporated by reference, discloses a preferred method of separating receiver elements from the imaging layers. The thermal solvents of this invention are particularly effective in aiding the transfer of dyes formed by reaction of couplers with oxidized developer or by other means from imaging layers to a receiver element. The receiving element, containing the transferred dye image, is then separated from the imaging layers. Said separated receiving element constitutes the final print material.

In the present invention, thermal solvents are included in a chromogenic photographic dye-diffusion-transfer element, substantially dry and activated by heat, and comprising contacting dye-receiver and dye-donor layers. Said element comprises a layer which contains a thermal solvent according to formula (I)

(I)

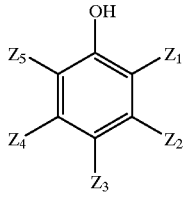

wherein $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

the calculated logP for I is greater than 3 and less than 10.

A list of preferred compounds is given in Tables I, II, and III.

TABLE I

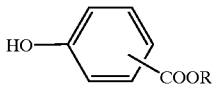

| Compound | Position (p or m) | R |
|---|---|---|
| I-1 | p | 1-hexyl |
| I-2 | p | cyclohexyl |
| I-3 | p | phenyl |
| I-4 | p | cyclopentylmethyl |
| I-5 | p | 2-hexyl |
| I-6 | p | 3-hexyl |
| I-7 | p | 2-ethyl-1-butyl |
| I-8 | p | 3,3-dimethyl-2-butyl |
| I-9 | p | 2-methyl-1-pentyl |
| I-10 | p | 2-methyl-2-pentyl |
| I-11 | p | 3-methyl-1-pentyl |
| I-12 | p | 4-methyl-2-pentyl |
| I-13 | p | 4-methyl-1-pentyl |
| I-14 | m | 1-hexyl |
| I-15 | m | cyclohexyl |
| I-16 | m | phenyl |
| I-17 | m | cyclopentylmethyl |
| I-18 | m | 2-hexyl |
| I-19 | m | 3-hexyl |
| I-20 | m | 2-ethyl-1-butyl |
| I-21 | m | 3,3-dimethyl-2-butyl |
| I-22 | m | 2-methyl-1-pentyl |

TABLE I-continued

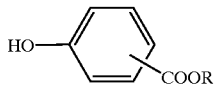

| Compound | Position (p or m) | R |
|---|---|---|
| I-23 | m | 2-methyl-2-pentyl |
| I-24 | m | 3-methyl-1-pentyl |
| I-25 | m | 4-methyl-2-pentyl |
| I-26 | m | 4-methyl-1-pentyl |
| I-27 | p | 1-heptyl |
| I-28 | p | benzyl |
| I-29 | p | tolyl |
| I-30 | p | 2-methyl-1-phenyl |
| I-31 | p | 3-methyl-1-phenyl |
| I-32 | p | 2,2-dimethyl-3-pentyl |
| I-33 | p | 2,3-dimethyl-3-pentyl |
| I-34 | p | 3-ethyl-2-pentyl |
| I-35 | p | 3-ethyl-3-pentyl |
| I-36 | p | 2-heptyl |
| I-37 | p | 2-methyl-2-hexyl |
| I-38 | p | 3-methyl-2-hexyl |
| I-39 | p | 5-methyl-2-hexyl |
| I-40 | p | 2-methyl-5-hexyl |
| I-41 | p | cycloheptyl |
| I-42 | p | 2-methyl-1-cyclohexyl |
| I-43 | p | 3-methyl-1-cyclohexyl |
| I-44 | p | 4-methyl-1-cyclohexyl |
| I-45 | p | hexahydrobenzyl |
| I-46 | m | 1-heptyl |
| I-47 | m | benzyl |
| I-48 | m | tolyl |
| I-49 | m | 2-methyl-1-phenyl |
| I-50 | m | 3-methyl-1-phenyl |
| I-51 | m | 2,2-dimethyl-3-pentyl |
| I-52 | m | 2,3-dimethyl-3-pentyl |
| I-53 | m | 3-ethyl-2-pentyl |
| I-54 | m | 3-ethyl-3-pentyl |
| I-55 | m | 2-heptyl |
| I-56 | m | 2-methyl-2-hexyl |
| I-57 | m | 3-methyl-2-hexyl |
| I-58 | m | 5-methyl-2-hexyl |
| I-59 | m | 2-methyl-5-hexyl |
| I-60 | m | cycloheptyl |
| I-61 | m | 2-methyl-1-cyclohexyl |
| I-62 | m | 3-methyl-1-cyclohexyl |
| I-63 | m | 4-methyl-1-cyclohexyl |
| I-64 | m | hexahydrobenzyl |
| I-65 | p | 2-ethyl-1-hexyl |
| I-66 | p | 1-octyl |
| I-67 | p | 2,2-dimethyl-3-hexyl |
| I-68 | p | 2,3-dimethyl-2-hexyl |
| I-69 | p | 3-ethyl-3-hexyl |
| I-70 | p | 2,4-dimethyl-3-hexyl |
| I-71 | p | 3,4-dimethyl-2-hexyl |
| I-72 | p | 3,5-dimethyl-3-hexyl |
| I-73 | p | 2-methyl-2-heptyl |
| I-74 | p | 3-methyl-5-heptyl |
| I-75 | p | 4-methyl-4-heptyl |
| I-76 | p | 6-methyl-2-heptyl |
| I-77 | p | 2,4,4-trimethyl-2-pentyl |
| I-78 | p | cyclohexylethyl |
| I-79 | p | cycloheptylmethyl |
| I-80 | p | 3,5-dimethyl-1-cyclohexyl |
| I-81 | p | 2,6-dimethyl-1-cyclohexyl |
| I-82 | m | 2-ethyl-1-hexyl |
| I-83 | m | 1-octyl |
| I-84 | m | 2,2-dimethyl-3-hexyl |
| I-85 | m | 2,3-dimethyl-2-hexyl |
| I-86 | m | 3-ethyl-3-hexyl |
| I-87 | m | 2,4-dimethyl-3-hexyl |
| I-88 | m | 3,4-dimethyl-2-hexyl |
| I-89 | m | 3,5-dimethyl-3-hexyl |
| I-90 | m | 2-methyl-2-heptyl |
| I-91 | m | 3-methyl-5-heptyl |
| I-92 | m | 4-methyl-4-heptyl |
| I-93 | m | 6-methyl-2-heptyl |

TABLE I-continued

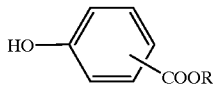

| Compound | Position (p or m) | R |
|---|---|---|
| I-94 | m | 2,4,4-trimethyl-2-pentyl |
| I-95 | m | cyclohexylethyl |
| I-96 | m | cycloheptylmethyl |
| I-97 | m | 3,5-dimethyl-1-cyclohexyl |
| I-98 | m | 2,6-dimethyl-1-cyclohexyl |
| I-99 | p | 1-nonyl |
| I-100 | p | 2-nonyl |
| I-101 | p | 3-nonyl |
| I-102 | p | 4-nonyl |
| I-103 | p | 5-nonyl |
| I-104 | p | 2-methyl-3-octyl |
| I-105 | p | 2-methyl-4-octyl |
| I-106 | p | 3-methyl-3-octyl |
| I-107 | p | 4-methyl-4-octyl |
| I-108 | p | 4-ethyl-4-heptyl |
| I-109 | p | 2,4-dimethyl-3-heptyl |
| I-110 | p | 2,6-dimethyl-4-heptyl |
| I-111 | p | 1,3-diisobutyl-2-propyl |
| I-112 | p | 2,2,3-trimethyl-3-hexyl |
| I-113 | p | 3,5,5-trimethyl-1-hexyl |
| I-114 | p | 3-cyclohexyl-1-propyl |
| I-115 | p | 1-methyl-1-cyclooctyl |
| I-116 | p | 3,3,5-trimethylcyclohexyl |
| I-117 | m | 1-nonyl |
| I-118 | m | 2-nonyl |
| I-119 | m | 3-nonyl |
| I-120 | m | 4-nonyl |
| I-121 | m | 5-nonyl |
| I-122 | m | 2-methyl-3-octyl |
| I-123 | m | 2-methyl-4-octyl |
| I-124 | m | 3-methyl-3-octyl |
| I-125 | m | 4-methyl-4-octyl |
| I-126 | m | 4-ethyl-4-heptyl |
| I-127 | m | 2,4-dimethyl-3-heptyl |
| I-128 | m | 2,6-dimethyl-4-heptyl |
| I-129 | m | 1,3-diisobutyl-2-propyl |
| I-130 | m | 2,2,3-trimethyl-3-hexyl |
| I-131 | m | 3,5,5-trimethyl-1-hexyl |
| I-132 | m | 3-cyclohexyl-1-propyl |
| I-133 | m | 1-methyl-1-cyclooctyl |
| I-134 | m | 3,3,5-trimethylcyclohexyl |
| I-135 | p | 1-decyl |
| I-136 | p | 2-decyl |
| I-137 | p | 3-decyl |
| I-138 | p | 4-decyl |
| I-139 | p | 5-decyl |
| I-140 | p | 2,2-dimethyl-3-octyl |
| I-141 | p | 4,7-dimethyl-4-octyl |
| I-142 | p | 2,5-dimethyl-5-octyl |
| I-143 | p | 3,7-dimethyl-1-octyl |
| I-144 | p | 3,7-dimethyl-3-octyl |
| I-145 | m | 1-decyl |
| I-146 | m | 2-decyl |
| I-147 | m | 3-decyl |
| I-148 | m | 4-decyl |
| I-149 | m | 5-decyl |
| I-150 | m | 2,2-dimethyl-3-octyl |
| I-151 | m | 4,7-dimethyl-4-octyl |
| I-152 | m | 2,5-dimethyl-5-octyl |
| I-153 | m | 3,7-dimethyl-1-octyl |
| I-154 | m | 3,7-dimethyl-3-octyl |
| I-155 | p | 2-methyl-4-octyl |
| I-156 | p | 3-methyl-3-octyl |
| I-157 | p | 4-methyl-4-octyl |
| I-158 | p | 4-ethyl-4-heptyl |
| I-159 | p | 2,4-dimethyl-3-heptyl |
| I-160 | p | 2,6-dimethyl-4-heptyl |
| I-161 | p | 1,3-diisobutyl-2-propyl |
| I-162 | p | 2,2,3-trimethyl-3-hexyl |
| I-163 | p | 3,5,5-trimethyl-1-hexyl |
| I-164 | p | 2-methyl-4-octyl |

TABLE I-continued

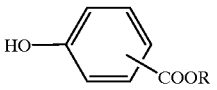

| Compound | Position (p or m) | R |
|---|---|---|
| I-165 | p | 3-methyl-3-octyl |
| I-166 | p | 4-methyl-4-octyl |
| I-167 | p | 4-ethyl-4-heptyl |
| I-168 | p | 2,4-dimethyl-3-heptyl |
| I-169 | p | 2,6-dimethyl-4-heptyl |
| I-170 | p | 1,3-diisobutyl-2-propyl |
| I-171 | p | 2,2,3-trimethyl-3-hexyl |
| I-172 | p | 3,5,5-trimethyl-1-hexyl |
| I-173 | p | 1-undecyl |
| I-174 | p | 2-undecyl |
| I-175 | p | 5-undecyl |
| I-176 | p | 6-undecyl |
| I-177 | m | 1-undecyl |
| I-178 | m | 2-undecyl |
| I-179 | m | 5-undecyl |
| I-180 | m | 6-undecyl |
| I-181 | p | 1-dodecyl |
| I-182 | p | 2-dodecyl |
| I-183 | p | 2-butyl-1-octyl |
| I-184 | p | 2,6,8-trimethyl-4-nonyl |
| I-185 | p | cyclododecyl |
| I-186 | m | 1-dodecyl |
| I-187 | m | 2-dodecyl |
| I-188 | m | 2-butyl-1-octyl |
| I-189 | m | 2,6,8-trimethyl-4-nonyl |
| I-190 | m | cyclododecyl |
| I-191 | p | 1-tridecyl |
| I-192 | m | 1-tridecyl |
| I-193 | m | 2-pentyl-1-nonyl |
| I-194 | p | 1-hexadecyl |
| I-195 | p | 2-hexadecyl |
| I-196 | p | 2-hexyl-1-decyl |
| I-197 | m | 1-hexadecyl |
| I-198 | m | 2-hexadecyl |
| I-199 | m | 2-hexyl-1-decyl |

TABLE II

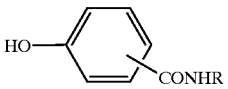

| Compound | Position (p or m) | R |
|---|---|---|
| II-1 | p | 1-hexyl |
| II-2 | p | 2-hexyl |
| II-3 | p | 1-methyl-1-pentyl |
| II-4 | p | cyclohexyl |
| II-5 | p | 1-heptyl |
| II-6 | p | 2-heptyl |
| II-7 | p | 4-heptyl |
| II-8 | p | 5-methyl-2-hexyl |
| II-9 | p | 1,4-dimethyl-1-pentyl |
| II-10 | p | cyclohexylmethyl |
| II-11 | p | 2-methyl-1-cyclohexyl |
| II-12 | p | 3-methyl-1-cyclohexyl |
| II-13 | m | 1-heptyl |
| II-14 | m | 2-heptyl |
| II-15 | m | 4-heptyl |
| II-16 | m | 5-methyl-2-hexyl |
| II-17 | m | 1,4-dimethyl-1-pentyl |
| II-18 | m | cyclohexylmethyl |
| II-19 | m | 2-methyl-1-cyclohexyl |
| II-20 | m | 3-methyl-1-cyclohexyl |
| II-21 | p | 1,1,3,3-tetramethyl-1-butyl |
| II-22 | p | 1-octyl |
| II-23 | p | 1-methyl-1-heptyl |

TABLE II-continued

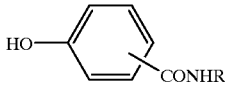

| Compound | Position (p or m) | R |
|---|---|---|
| II-24 | p | 2-ethyl-2-hexyl |
| II-25 | p | 2-methyl-1-heptyl |
| II-26 | p | 6-methyl-2-heptyl |
| II-27 | p | cyclooctyl |
| II-28 | p | 2-cyclohexyl-1-ethyl |
| II-29 | m | 1,1,3,3-tetramethyl-1-butyl |
| II-30 | m | 1-octyl |
| II-31 | m | 1-methyl-1-heptyl |
| II-32 | m | 2-ethyl-2-hexyl |
| II-33 | m | 2-methyl-1-heptyl |
| II-34 | m | 6-methyl-2-heptyl |
| II-35 | m | cyclooctyl |
| II-36 | m | 2-cyclohexyl-1-ethyl |
| II-37 | p | 5-nonyl |
| II-38 | p | 1-nonyl |
| II-39 | p | cyclooctylmethyl |
| II-40 | m | 5-nonyl |
| II-41 | m | 1-nonyl |
| II-42 | m | cyclooctylmethyl |
| II-43 | p | 1-decyl |
| II-44 | m | 1-decyl |
| II-45 | p | 2-undecyl |
| II-46 | p | 4-undecyl |
| II-47 | m | 2-undecyl |
| II-48 | m | 4-undecyl |
| II-49 | p | 1-dodecyl |
| II-50 | p | cyclododecyl |
| II-51 | m | 1-dodecyl |
| II-52 | m | cyclododecyl |
| II-53 | p | 2-tridecyl |
| II-54 | m | 2-tridecyl |
| II-55 | p | 1-tetradecylamine |
| II-56 | m | 1-tetradecylamine |

TABLE III

| | |
|---|---|
| III-1 | 3,4,5-trihydroxy-2'-ethyl-1'-hexyl benzoate |
| III-2 | 3,4,5-trihydroxy-1'-octyl benzoate |
| III-3 | 3,4,5-trihydroxy-2'-,2'-dimethyl-3'-hexyl benzoate |
| III-4 | 3,4,5-trihydroxy-1'-nonyl benzoate |
| III-5 | 3,4,5-trihydroxy-l'-decyl benzoate |
| III-6 | 1,8-octyl-bis(4'-hydroxy benzoate) |
| III-7 | 1,8-octyl-bis(3'-hydroxy benzoate) |
| III-8 | 1,10-decyl-bis(4'-hydroxy benzoate) |
| III-9 | 1,10-decyl-bis(3'-hydroxy benzoate) |
| III-10 | 3,7-dimethyl-1,7-octyl-bis(4'-hydroxy benzoate) |
| III-11 | 1,11-undecyl-bis(4'-hydroxy benzoate) |
| III-12 | 1,12-dodecyl-bis(4'-hydroxy benzoate) |
| III-13 | 1,12-dodecyl-bis(3'-hydroxy benzoate) |
| III-14 | 1,8-octyl-bis(4'-hydroxy benzamide) |
| III-15 | 1,8-octyl-bis(3'-hydroxy benzamide) |
| III-16 | 1,4-cyclohexane-bis(methyl-4'-hydroxy benzamide) |
| III-17 | 1,4-cyclohexane-bis(methyl-3'-hydroxy benzamide) |
| III-18 | 1-(methyl-4'-hydroxy benzamide)-4-(methyl-3"-hydroxy benzamide)-cyclohexane |
| III-19 | 1,9-nonyl-bis(4'-hydroxy benzamide) |
| III-20 | 1,10-decyl-bis(4'-hydroxy benzamide) |
| III-21 | 1,10-decyl-bis(3'-hydroxy benzamide) |
| III-22 | 1,12-dodecyl-bis(4'-hydroxy benzamide) |
| III-23 | 1,12-dodecyl-bis(3'-hydroxy benzamide) |
| III-24 | 3,4-dichloro-5-(1'-heptyl) phenol |
| III-25 | 3,4-dichloro-5-(1'-octyl) phenol |
| III-26 | 3,4-dichloro-5-(2'-ethyl-1'-hexyl) phenol |
| III-27 | 3,4-dichloro-5-(1'-nonyl) phenol |
| III-28 | 3,4-dichloro-5-(1'-decyl) phenol |
| III-29 | 3,4-dichloro-5-(1'-dodecyl) phenol |
| III-30 | 5-hydroxy-di-(1'-hexyl) isophthalate |
| III-31 | 5-hydroxy-di-(1'-heptyl) isophthalate |
| III-32 | 5-hydroxy-di-(1'-octyl) isophthalate |

TABLE III-continued

| | |
|---|---|
| III-33 | 5-hydroxy-di-(2'-ethyl-l'-hexyl) isophthalate |
| III-34 | 5-hydroxy-di-(1'-nonyl) isophthalate |
| III-35 | 5-hydroxy-di-(1'-decyl) isophthalate |
| III-36 | 5-hydroxy-di-(1'-undecyl) isophthalate |
| III-37 | 5-hydroxy-di-(1'-dodecyl) isophthalate |

The coupler compound which is to be contained in the color photographic material to be used in the process of the invention may be any coupler designed to be developable by conventional color developer solutions, and to form a heat transferable dye upon such conventional development While color images may be formed with coupler compounds which form dyes of essentially any hue, couplers which form heat transferable cyan, rnagenta, or yellow dyes upon reaction with oxidized color developing agents are used in preferred embodiments of the invention.

A typical multilayer, multicolor photographic element to be used with the thermal solvents of this invention comprises a support having thereon a red-sensitive silver halide emulsion layer having associated therewith a cyan dye image forming coupler compound, a green-sensitive silver halide emulsion layer having associated therewith a magenta dye image forming coupler compound and a blue-sensitive silver halide emulsion layer having associated therewith a yellow dye image forming coupler compound. Each silver halide emulsion layer can be composed of one or more layers and the layers can be arranged in different locations with respect to one another. Typical arrangements are described in *Research Disclosure* Issue Number 308, pp. 993–1015, published December, 1989 (hereafter referred to as "*Research Disclosure*"), the disclosure of which is incorporated by reference.

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or pre-dominantly on the interior of the silver halide grains. They can be chemically or spectrally sensitized. The emulsions typically will be gelatin emulsions although other hydrophilic colloids as disclosed in *Research Disclosure* can be used in accordance with usual practice.

The support can be of any suitable material used with photographic elements. Typically, a flexible support is employed, such as a polymeric film or paper support. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with polymer of an alpha-olefm containing 2 to 10 carbon atoms such as polyethylene, polypropylene or ethylene butene copolymers. The support may be any desired thickness, depending upon the desired end use of the element. In general, polymeric supports are usually from about 3 $\mu$m to about 200 $\mu$m and paper supports are generally from about 50 $\mu$m to about 1000 $\mu$m.

TMe dye-receiving layer to which the formed dye image is transferred according to the invention may be coated on the photographic element between the emulsion layer and support, or may be in a separate dye-receiving element which is brought into contact with the photographic element during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly (caprolactone)s and mixtures thereof. The dye receiving layer may be present in any amount which is effective for the intended purpose. In general, good results have been obtained at a concentration of from about 1 to about 10 $g/m^2$ when coated on a support In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylylene glycol, 2,2-bis(4oxyphenyl)propane, bis(4-oxyphenyl) methane, 1,1-bis(4-oxyphenyl)ethane, 1,1-bis(oxyphenyl) butane, 1,1-bisphenol-A polycarbonate having a number average molecular weight of at least about 25,000 is used. Examples of preferred polycarbonates include General Electric LEXAN® Polycarbonate Resin and Bayer AG MACROLON® 5700. Further, a thermal dye transfer overcoat polymer as described in U.S. Pat. No. 4,775,657 may also be used.

Heating times of from about 10 seconds to 30 minutes at tempeatures of from about 50 to 200° C. (more preferably 75 to 160° C., and most preferably 80 to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75 to 190° C.

Another method of imaging combines thermal or heat development of radiation sensitive silver halide, usually in the presence of an organic silver salt and an incorporated reducing agent, with thermally activated diffusion transfer of image dyes to a polymeric receiver. Such systems are described in U.S. Pat. Nos. 4,584,267, 4,590,154, 4,595,652, 4,770,981, 4,871,647, 4,948,698, 4,952,479, and 4,983,502, the disclosures of which are incorporated herein by reference. Such materials generally comprise a plurality of radiation sensitive layers. A typical radiation sensitive layer comprises radiation sensitive silver halide, an organic silver salt, a reducing agent, a dye forming or donating compound, a binder, and in preferred embodiments, one or more thermal solvents to facilitate the heat development of the silver halide and organic silver salt and the transfer of the resulting image dye to a suitable receiving element. In preferred multilayer materials, radiation sensitive layers sensitive to blue, green, and red light are included that produce yellow, magenta, and cyan image dyes for diffusion transfer, respectively. Thermal solvents and heat solvents of the type disclosed in the aforesaid U.S. Patent documents and disclosed herein by reference are included to facilitate heat development and thermal dye transfer. The preferred thermal solvents of the present invention serve to facilitate the thermal dye transfer of dyes through the binder to the receiver element.

The coupler compound to be used in this process of the invention may be any dye forming, dye providing, or dye donating material that will produce a heat transferable dye upon heat development. Preferred dye forming compounds are those that provide heat transferable cyan, magenta, or yellow dyes upon heat development.

The dye-providing materials of the present invention may be used either on their own or as admixtures. If desired, they may be used in combination with dye-providing materials of the type described in such patents as U.S. Pat. Nos. 4,631, 251, 4,656,124, and 4,650,748.

The amount of the dye-providing materials used is not limited and may be determined according to their type, the manner in which they are used (i.e., either singly or in combination) or the number of photographic constituent layers of which the heat-processible photographic material of the present invention is composed (i.e., a single layer or two or more layers in superposition). As a guide, the dye-providing materials may be used in an amount of 0.005–50 g, preferably 0.1–10 g, per square meter. The dye-providing materials for use in the present invention may be incorporated in photographic constituent layers of the heat-processible photographic material by any suitable method.

The light-sensitive silver halide to be used in the present invention may include, for example, silver chloride, silver bromide, silver iodide, silver chlorobromide, silver chloroiodide and silver iodobromide. Such light-sensitive silver halides can be prepared by any of the methods commonly employed in the photographic art.

If desired, a silver halide emulsion having silver halide grains with a duplex structure (i.e., the halide composition of the grain surface differing from that of the interior) may be used and an example of such duplex grains is core/shell type silver halide grains. The shell of these grains may change in halide composition stepwise or gradually. The silver halide grains used may have a well-defined crystal habit as in cubes, spheres, octahedra, dodecahedra or tetradecahedra. Alternatively, they may not have any well-defined crystal shape. The silver halide grains in these light-sensitive emulsions may be coarse or fine; preferred grain sizes are on the order of 0.005 $\mu$m to 1.5 $\mu$m in diameter, with the range of from about 0.01 to about 0.5 $\mu$m being more preferred.

According to another method for preparing light-sensitive silver halides, a light-sensitive silver salt forming component may be used in the presence of organic silver salts (to be described below) so as to form light-sensitive silver halides in part of the organic silver salts.

These light-sensitive silver halides and light-sensitive silver salt forming component may be used in combination in a variety of methods, and the amount used in one photographic layer preferably ranges from 0.001 to 50 g, preferably 0.1–10 g, per square meter of base support.

The light-sensitive silver halide emulsions illustrated above may be chemically sensitized by any of the methods commonly employed in the photographic art The light-sensitive silver halide emulsions to be used in the present invention may be spectrally sensitized with known spectral sensitizers in order to provide sensitivity to the blue, green, red, or near-infrared region.

Typical examples of the spectral sensitizers that can be used in the present invention include cyanine dyes, merocyanine dyes, complex (tri- or tetra-nuclear) cyanine dyes, holopolar cyanine dyes, styryl dyes, hemicyanine dyes and oxonol dyes. These sensitizers are incorporated in amounts ranging from $1\times10^{-4}$ to 1 mole, preferably from $1\times10^{-4}$ to $1\times10^{-1}$ mole, per mole of the light-sensitive silver halide or silver halide forming component. The sensitizers may be added at any stage of the preparation of silver halide emulsions; they may be added during the formation of silver halide grains, during the removal of soluble salts, before the start of chemical sensitization, duing chemical sensitization or after completion of the chemical sensitization.

A variety of organc silver salts may opfionally be employed in the heat-processible photographic material of the present invention in order to increase its sensitivity or improve its developability.

Illustrating organic silver salts that may be employed in the heat-processible photographic material of the present invention include: silver salts of long-chain aliphatic carboxylic acids and silver salts of carboxylic acids having a hetero ring, such as silver behenate and silver α-(1-phenyltetrazolethio) acetate (see U.S. Pat Nos. 3,330,633, 3,704,496 and 4,105,451): and silver salts of an imino pup as described in U.S. Pat. No. 4,123,274.

Among the organic silver salts listed above, silver salts of an imino group are preferred. Particularly preferred are silver salts of benzotdazole derivatives such as 5-methylbenzotriazole or derivatives thereof, sulfobenzotriazole or derivatives thereof and N-alkylsulfamoylbenzotriazole or derivatives thereof.

These organic silver salts may be used either singly or as admixtures in the present invention. Silver salts prepared in suitable binders may be immediately used without being isolated. Alternatively, isolated silver salts may be dispersed in binders by suitable means before they are used The organic silver salts are preferably used in amounts ranging from 0.01 to 500 moles, more preferably from 0.1 to 100 moles, most preferably from 0.3 to 30 moles, per mole of the light-sensitive silver halide.

The reducing agent for use in the heat-processible photographic material of the present invention (the texin "reducing agent" as used herein shall include precursors of the reducing agent) may be selected from among those which are commonly employed in the field of heat-processible photographic materials.

Reducing agents that can be used in the present invention include: p-phenylene-diamine-based or p-aminophenolic developing agents, phosphoroamidophenolic developing agents, sulfonamidoaniline-based developing agents, hydrazone-based color developing agents, and precursors of these developing agents, such as those described in U.S. Pat. Nos. 3,531,286, 3,761,270, and 3,764,328. Also useful are phenols, sulfonamidophenols, polyhydroxybenzenes, naphthols, hydroxybinaphthyls, methylenebisnaphthols, methylenebisphenols, ascorbic acids, 3-pyrazolidones, pyrazolones, etc. The reducing agents may be used either on their own or as admixtures. The amount in which the reducing agents are used in the heat-processible photographic material of the present invention depend upon many factor.; such as the type of light-sensitive silver halide used, the type of organic acid silver salt, and the type of other additives used. Usually, the reducing agents are used in amounts ranging from 0.01 to 1,500 moles per mole of light-sensitive silver halide, with the range of 0.1–200 moles being preferred Illustrative binders that can be employed in the heat-processible photographic material of the present invention include: synthetic high-molecular compounds such as polyvinylbural, polyvinyl acetate, ethyl cellulose, polymethyl methacrylate, cellulose acetate butyrate, polyvinyl alcohol and polyvinylpyrrolidone; synthetic or natural high-molecular compounds such as gelatin, gelatin derivatives (e.g., phthalated gelatin), cellulose derivatives, proteins, starches, and gum arabic. These high-molecular compounds may be used either singly or in combination. It is particularly preferred to employ gelatin or its derivatives in combination with synthetic hydrophilic polymers such as polyvinylpyrrolidone and polyvinyl alcohol A more preferred binder is a mixture of gelatin and polyvinylpyrrolidone.

The binders are generally used in amounts ranging from 0.05 to 50 g, preferably from 0.2 to 20 g, per square meter of the base support. The binders are preferably used in amounts of 0.1–10 g, more preferably 0.2–5 g, per gram of the dye-providing material.

The heat-processible photographic material of the present invention is produced by forming photographic constituent layers on a base support. A variety of base supports can be used and they include: synthetic plastic films such as a polyethylene film, a cellulose acetate film, a polyethylene terephthalate film, and a polyvinyl chloride film; paper bases such as photographic raw paper, printing paper, baryta paper and resin-coated paper, and base prepared by coating these materials with electron-beam curable resin compositions, followed by curing of the same.

The heat-processible photographic material of the present invention is suitable for processing by transfer photography using an image-receiving member. In the practice of the present invention, a variety of thermal solvents are preferably incorporated in the heat-processible photographic material and/or the image-receiving member.

Particularly useful thermal solvents are urea derivatives (e.g., dimethylurea, diethylurea and phenylurea), amide derivatives (e.g., acetamide, benzamide and p-toluamide), sulfonamide derivatives (e.g., benzenesulfonamide and α-toluene-sulfonamide), and polyhydric alcohols (e.g., 1,6-hexanediol, 1,2-cyclohexanediol and pentaerytlritol, and polyethylene glycol. Water-insoluble solid thermal solvents may be used with particular advantage.

Thermal solvents may be incorporated in various layers such as light-sensitive silver halide emulsion layers, intermediate layers, protective layers, and image-receiving layers in an image-receiving member so that the results desired in respective cases can be obtained.

Thermal solvents are usually incorporated in amounts ranging from 10 to 500 wt %, preferably from 30 to 200 wt %, of the binder.

The organic silver salts and thermal solvents may be dispersed in the same liquid dispersion system. The binder, dispersion medium and dispersing apparatus used in this case may be the same as those employed in preparing the respective liquid dispersions.

Besides the components described above, the heat-processible photographic material of the present invention may incorporate various other additives such as development accelerators, antifoggants, base precursors, etc.

Illustrative base precursors include compounds that undergo decarboxylation upon heating to release a basic substance (e.g., guanidium trichloroacetate) and compounds that are decomposed by reactions such as intramolecular nucleophilic substitution reaction to release amines. Other additives that are used as required in heat-processible photographic materials may also be incorporated in the heat-processible photographic material of the present invention. Illustrative additives include antihalation dyes, brighteners, hardeners, antistats, plasticizers, extenders, matting agents, surface-active agents and antifading agents. These additives may be incorporated not only into light-sensitive layers but also into non-light-sensitive layers such as intermediate layers, protective layers and backing layers.

The heat-processible photographic material of the present invention contains (a) a light-sensitive silver halide, (b) a reducing agent, (c) a binder and (d) the dye-providing material of the present invention. Preferably, it further contains (e) an organic silver salt as required. In a basic mode, these components may be incorporated in one heat-processible light-sensitive layer but it should be noted that they are not necessarily incorporated in a single photographic constituent layer but may be incorporated in two or more constituent layers in such a way that they are held mutually reactive. In one instance, a heat-processible light-sensitive layer is divided into two sublayers and components (a), (b), (c) and (e) are incorporated in one sub-layer with the dye-providing material (d) being incorporated in the other sub-layer which is adjacent to the first sublayer. The heat-processible light-sensitive layer may be divided into two or more layers including a highly sensitive layer and a less sensitive layer, or a high-density layer and a low-density layer.

The heat-processible photographic material of the present invention has one or more heat-processible light-sensitive layers on a base support If it is to be used as a full-color light-sensitive material, the heat-processible photographic material of the invention generally has three heat-processible light-sensitive layers having different color sensitivities, each light-sensitive layer forming or releasing a dye of different color as a result of themal development. A blue-sensitive layer is usually combined with a yellow dye, a green-sensitive layer with a magenta dye, and a red-sensitive layer with a cyan dye, but different combinations may be used.

The choice of layer arrangements depends on the objective of a specific use. For instance, a base support is coated with a red-sensitive, a green-sensitive and a blue-sensitive layer, or in the reverse order (i.e., a blue-sensitive, a green-sensitive and a red-sensitive layer), or the support may be coated with a green-sensitive, a red-sensitive and a blue-sensitive layer.

Besides the heat-processible light-sensitive layers described above, the heat-processible photographic material of the present invention may incorporate non-light-sensitive layers such as a subbing layer, an intermediate layer, a protective layer, a filter layer, a backing layer and a release layer. The heat-processible light-sensitive layers and these non-light-sensitive layers may be applied to a base support by coating techniques that are similar to those commonly employed to coat and prepare ordinary silver halide photographic materials.

The heat-processible photographic material of the present invention is developed after imagewise exposure and this can usually be done by merely heating the material at a temperature in the range of 80°–200° C., preferably 100°–170° C., for a period of from 1–180 seconds, preferably 1.5–120 seconds. A diffusible dye may be transferred onto an image-receiving layer simultaneously with thermal development by bringing the image-receiving layer in the image-receiving member into intimate contact with the light-sensitive surface of the photographic material, alternatively, the photographic material brought into intimate contact with the image-receiving member after thermal development may be subsequently heated. The photographic material may be preliminarily heated in the temperature range of 70°–180° C. prior to exposure. In order to enhance the adhesion between the photographic material and the image-receiving member, they may be separately heated at a temperature of 80°–250° C. just prior to thermal development and transfer.

The heat-processible photographic material of the present invention permits the use of a variety of known heating techniques. All methods of heating that can be used with ordinary heat-processible photographic materials may be applied to the heat-processible photographic material of the present invention. In one instance, the photographic material may be brought into contact with a heated block or plate, or with heated rollers or a hot drunm Alternatively, the material may be passed through a hot atmosphere. High-frequency heating is also applicable. The heating pattern is in no way limited; preheating may be followed by another cycle of heating; heating may be performed for a short period at high temperatures or for a long period at low temperatures; the temperature may be elevated and lowered continuously; repeated cycles of heating may be employed; the heating may be discontinuous rather than continuous. A simple heating pattern is preferred If desired, exposure and heating may proceed simultaneously. Any image-receiving member may effectively be used in the present invention if the image-receiving layer employed has a capability for accepting the dye released or formed in the heat-processible light-sensitive layer as a result of thermal development. A preferred example is a polymer containing a tertiary amine or quaternary ammonium salt, as described in U.S. Pat. No. 3,709,690. Typical image-receiving layers suitable for use in diffusion transfer can be prepared by coating a base support, with a mixture in which a polymer containing an ammonium salt or tertiary amine is combined with gelatin or polyvinyl alcohol. Another useful dye-receiving layer may be formed of a heat-resistant organic high-molecular substance having a glass transition point of 40°–250° C. These polymers may be carried as image-receiving layers on a base support; alternatively, they may be used as bases on their own.

Synthetic polymers having glass transition points of 40° C. and above as described in "Polymer Handbook," 2nd ed., edited by J. Brandrup and E. H. Immergut, John Wiley & Sons are also useful. Useful molecular weights of these high-molecular substances are generally in the range of 2,000–200,000. These high-molecular substances may be used either independently or as blends. Two or more monomers may be employed to make copolymers. Particularly preferred image-receiving layers comprise polyvinyl chloride and polycarbonate, and a plasticizer.

The polymers described above may be used as base supports that also serve as image-receiving layers to form image-receiving members. In this case, the base support may be formed of a single layer or two or more layers.

Base supports for image-receiving members may be transparent or non-transparent. Illustrative supports include: films of polymers such as polyethylene terephthalate, polycarbonate, polystyrene, polyvinyl chloride, polyethylene and polypropylene; base supports having pigments such as titanium oxide, barium sulfate, calcium carbonate and talc incorporated in these plastic films; baryta paper, resin-coated (RC) paper having paper laminated with pigment-loaded thermoplastic resins; fabrics; glass; metals such as aluminum; base supports prepared by coating these materials with pigment-loaded electron beam curable resin compositions, followed by curing of the latter, and base supports having pigment-loaded coating layers on these materials.

Particularly useful are the base support prepared by coating paper with a pigment-loaded electron-beam curable resin composition, followed by curing of the resin, and the base support prepared by applying a pigment coating layer to paper, which is then coated with an electron-beam curable resin composition, followed by curing of the resin. These base supports can immediately be used as image-receiving members since the resin layer itself serves as an image-receiving layer.

The heat-processible photographic material of the present invention may be of the integral tppe in which the light-sensitive layer and the image-receiving layer are formed on the same base support.

The heat-processible photographic material of the present invention is preferably provided with a protective layer.

The protective layer may contain a variety of additives that are commonly employed in the photographic industry. Suitable additives include matting agents, colloidal silica, slip agents, organofluoro compounds (in particular, fluorine-based surface active agents), antistats, uv absorbers, high-boiling organic solvents, anti-oxidants, hydroquinone derivatives, polymer latexes, surface-active agents (including high-molecular surface-active agents), hardeners (including high-molecular hardeners), particulate organic silver salts, non-light-sensitive silver halide grains, antistats, development accelerators, etc.

A preferred embodiment of the present invention comprises a multilayer heat-developable color-photographic material comprising a dye-diffusion-transfer element, activated by heat, said transfer element comprising contacting dye-receiver and dye-donor layers, where said receiver layers comprise a support, a polymeric layer comprising materials which have a high binding affinity for the yellow, magenta, and cyan dyes, and where said donor layers comprise a yellow dye producing layer, said layer comprising light-sensitive silver halide grains, an organic silver salt, a reducing agent, a yellow dye providing compound, and a hydrophilic binder, a magenta dye producing layer, said layer comprising light-sensitive silver halide grains, an organic silver salt, a reducing agent, a magenta dye providing compound, and a hydrophilic binder, a cyan dye producing layer, said layer comprising light-sensitive silver halide grains, an organic silver salt, a reducing agent, a cyan dye providing compound, and a hydrophilic binder, wherein said binder of said layers amount to from 3 to 10 g/m$^2$ of said coated material. The dye-receiver and dye-donor layers may be coated together in a single, integral element. Alternatively, the dye-receiver and dye-donor layers may be coated in separate elements, said elements being laminated together prior to the thermal dyeAiffusion transfer process. The preferred amount of thermal solvent according to structure (I) incorporated in a given layer is 1 to 300% by weight of the total amount of binder present in said layer, more preferably the amount of such thermal solvent incorporated in a given layer is 20 to 150% by weight of the total amount of binder present in said layer, and most preferably the amount of such thermal solvent incorporated in a given layer is 50 to 120% by weight of the total amount of binder present in said layer.

The advantages of the present invention will become more apparent by reading the following examples. The scope of the present invention is by no means limited by these examples, however.

EXAMPLES 1–5

Compound I-65 of this invention was purchased from Pfaltz and Bauer. Comparison compounds, n-butyl phthalate, tricresyl phosphate, and N,N-diethyl dodecanamide were obtained from Kodak Laboratory Chemicals.

Thermal Solvent Dispersions

Colloid milled dispersions of the thermal solvents of this invention and of comparison compounds were prepared by methods well known in the art as aqueous gelatin oil-in-water emulsions, using dispersing aid DA obtained from Du Pont. On a weight basis, these aqueous dispersions were prepared as 4% thermal solvent or

DA

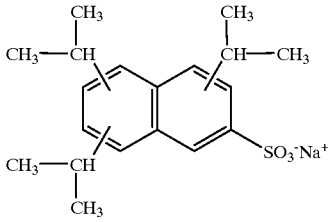

comparison compound and 4% gelatin, using 4 g of a 10% aqueous solution of DA. Such an aqueous suspension was passed through a colloid mill five times to obtain dispersions with submicron particle sizes. These dispersions were chill set and stored in a refrigerator until used for preparing photographic test elements.

Preparation of Receiver Element

A reflection base paper material, resin coated with high density polyethylene, was coated with a mixture of polycarbonate, polycaprolactone, and ST (1,4-didecyloxy-2,5-dimethoxy benzene) at a 0.77:0.115:0.115 weight ratio respectively, at a total coverage of 3.28 g/m$^2$.

Preparation of Test Element

A dispersion of coupler M was prepared by emulsifying 3 g of coupler M, dissolved in 15 g of refluxing ethyl acetate, with an aqueous gelatisurfactant solution at 50° C. (23 g 12.5% (w/w) aqueous gelatin, 3.2 g 10% (w/w) DA, 65 g water). This mixture was passed five times through a colloid mill, and the product was chill set and stored in the cold until used.

Figure 2:
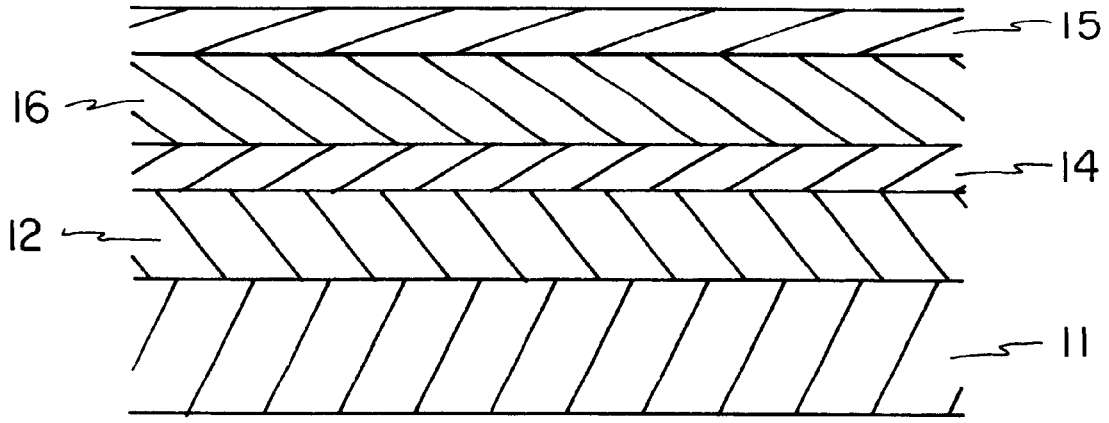
FIG. 2. Test coating format layer structure: 11—transparent or reflection base; 12—polymeric receiving layer, 14—interlayer containing gelatin and optionally thermal solvent; 15—protective overcoat layer, 16—diffusion transfer dye generation layer.

The overall layer structure for these tests is illustrated in FIG. 2. The interlayer was coated at a gelatin coverage of 1.07 g/m$^2$, and the test compounds (thermal solvents) were coated also at a coverage of 1.07 g/m$^2$ in this layer. Subsequently, a melt containing coupler (M) and green sensitized silver chloride emulsion in aqueous gelatin was coated over the test interlayer (14) to produce a light sensitive dye generating layer (16). This layer had a coverage of 1.61 g/m$^2$ of gelatin, 322 mg/m$^2$ of silver as silver chloride, and 322 mg/m$^2$ of coupler M. A protective overcoat (15) of gelatin at a coverage of 1.07 g/m$^2$ was coated over the light sensitive layer. Hardener, 1,1'-[methylene bis(sulfonyl)]bis-ethene, was coated at a level corresponding to 1.5% (w/w) of the total gelatin, to crosslink the gelatin.

Coupler M

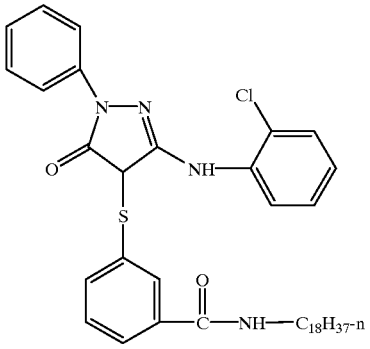

Processing and Sensitometry

The coatings of these examples were exposed and processed for 45" at 95° F. in a developer solution comprising the following:

| | |
|---|---|
| Triethanolamine - | 12.41 g |
| Phorwite REU (Mobay) - | 2.3 g |
| Lithium polystyrene sulfonate (30% aqueous solufion) - | 0.30 g |
| N,N-deithylhydroxylamine (85% aqueous solution) - | 5.40 g |
| Lithium sulfate - | 2.70 g |
| KODAK Color Developing Agent CD-3 - | 5.00 g |
| 1-Hydroxyethyl-1,1-diphosphonic acid (60% aqueous solution) - | 1.16 g |
| Potassium carbonate,anhydrous - | 21.16 g |
| Potassium bicarbonate - | 2.79 g |
| Potassium chloride - | 1.60 g |
| Potassium bromide - | 7.00 mg |
| Water to make one liter | |
| pH = 10.04 @ 27° C. | |

These coatings were then dipped in a stop bath, rinsed, and dried. The test coatings were then passed through pinch rollers heated to 105° C. under a nip pressure of 20 psi at a rate of 0.25 ips (inches per second). The test coatings were passed through with the photographic element coated sides in contact with the gelatin coated side of a stripping adhesion sheet, as described in U.S. Pat. No. 5,164,280. This adhesion sheet was subsequently removed by shear from the test element, thereby removing the layers 16 and 15 from the receiver/base combination (12 and 11). The resulting transferred dye scale was read by a reflection densitometry, and the corresponding $D_{max}$ are listed in Table IV. The results show that Compound I-65 of this invention has a dramatic effect on facilitating the thermal diffusion of dye through the interlayer (13) to the receiver. These results also show that the most common materials known in the art as coupler solvents are completely ineffective in promoting such dye diffusion transfer.

TABLE IV

| Example | Test Compound | $D_{max}$ |
|---|---|---|
| 1 | none (gelatin only) | 0.10 |
| 2 | di-n-butyl phthalate | 0.07 |
| 3 | tri-cresyl phosphate | 0.07 |
| 4 | N,N-diethyl lauramide | 0.07 |
| 5 | Compound I-65 (this invention) | 0.47 |

EXAMPLES 6–10

The same test format and procedures used in Examples 1 to 5 were used in preparing Examples 6 to 10, except that in the case of Example 6, no gelatin interlayer (14) was coated. Also, the pinch rollers were heated to a temperature of 110° C.; in the thermal dye transfer stage of processing. Compounds I-65, I-66, I-99, and I-181 of our invention were prepared and coated as thermal solvents as described above. The corresponding dye transfer results are shown below in Table V.

TABLE V

| Example | Test Compound | $D_{max}$ |
|---|---|---|
| 6 | none (no gelatin interlayer) | 0.43 |
| 7 | Compound I-65 (this invention) | 0.78 |
| 8 | Compound I-66 (this invention) | 1.14 |
| 9 | Compound I-99 (this invention) | 1.18 |
| 10 | Compound I-181 (this invention) | 0.65 |

These results in Table V show clearly that the compounds of this invention facilitate dye transfer though a gelatin interlayer to an extent superior to the amount of dye transfer that occurs in the absence of a blocking gelatin interlayer (Example 6).

EXAMPLES 11–13

The Compound A was presented in U.S. Pat. No. 4,948, 698 as a thermal solvent. In these examples we compare the efficacy of this comparison compound as a dye transfer thermal solvent, useful in the context of the dry thermally activated diffusion transfer described herein, to Compound I-65 of our invention.

Compound A

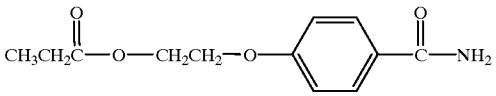

Preparation of Compound A

Methanol (365 mL) and 4-hydroxybenzamide (100 g, 0.73 mol; Aldrich) were placed in a 2-L three-necked flask set in an ice bath. To this mixture was added 29.2 g (0.73 mol) of NaOH pellets. The mixture was warmed to dissolve all of the NaOH, and then cooled to 10° C. in an ice/acetone bath. To this chilled mixture was added 91.2 g (0.73 mol) of 2-bromoethanol (Aldrich) in 140 mL methanol from a dropping funnel while maintaining the temperature below 15° C. The reaction mixture was warmed to room temperature, and then refluxed for 3 h on a steam bath. Thin layer chromatography eluted with ethyl acetate indicated the presence of some starting material in this reaction mixture.

An additional 4 g of NaOH (pellets) were added and the reaction mixture was refluxed overnighL The reaction mixture was cooled to 5–10° C. in an ice bath for 1 h and the white solid was collected. The liquors were concentrated and chilled to obtain a second crop. The combined solids were slurried for 1 h in cold water, collected by filtration, washed with water, washed with hexane, and air dried to yield 90 g. The proton NMR was consistent with the structure of the desired intermediate, i1, and the combustion analysis was satisfactory (found: C, 59.19%; H, 5.89%; N, 7.57%; calculated: C, 59.66%; H, 6.12%; N, 7.73%). The final compound A was prepared by placing triethylamine (76 g, 0.75 mol), dry ethyl acetate (450 mL), and intermediate i1 (42 g, 0.23 mol) in a 1-L four-neck flask, (i1)

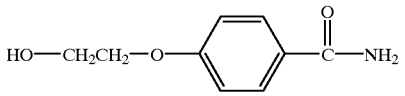

cooled in an ice bath. The mixture was cooled to 5° C. and 21.3 g (0.23 mol) of propionyl chloride in 60 mL of dry ethyl acetate was added over a 15–20 min interval from a dropping funnel slowly, keeping the temperature below 10° C. The reaction mixture was stired at 10–15° C. for 2 h. The reaction mixture was drowned in 2 L of ice water/HCl. More ethyl acetate was added. The insoluble white solid formed, about 15 g, was unreacted i1. The layers were separated and the aqueous layer was extracted with ethyl acetate. The combined ethyl acetate layers were washed three times with salt water, dried over $MgSO_4$, and concentrated to an oily solid (15 g). This crude product was slurried in 100 mL hexane for 20 min, collected, and dried to leave 7 g of product. This material was recrystallized from 50 mL of toluene to yield 3 g of Compound A. Combustion analysis was satisfactory (found: C, 60.39%; H, 6.27%; N, 5.88%; calculated: C, 60.75%; H, 6.37%; N, 5.90%).

Thermal Solvent Dispersions

A dispersion of Compound 2 if this invention was prepared identically as described above for Example 5. A similar disperison of Compound A was prepared, with the exception that it was prepared as an oil-in-water emulsion of an ethyl acetate solution of Compound A in aqueous gelatin/DA. After coating, the ethyl acetate was removed by evaporation.

Coating and Evaluation

Coatings and evaluations were done identically as above for Examples 6 to 10. The results are illustrated in Table VI. It is apparent that the Compound I-65 of our invention works quite well, whereas the comparison Compound A has no activity whatsover in facilitating the dry thermal diffusion of image dyes through gelatin.

TABLE VI

| Example | Test Compound | $D_{max}$ |
|---|---|---|
| 11 | none (no gelatin interlayer) | 0.43 |
| 12 | Compound A (comparison) | 0.01 |
| 13 | Compound I-65 (this invention) | 0.78 |

EXAMPLES 14–23

The same test format and procedures used in Examples 6 to 10 were used in preparing Examples 14 to 23. Compounds I-1, I-27, I-66, I-135, I-181, and II-49 of our invention were obtained from commercial sources. m-Toluamide, a "heat solvent" described in U.S. Pat. No. 4,948,698, was obtained from Kodak Laboratory Chemicals.

Preparation of Compound I-83 m-Hydroxy benzoic acid (46 g, 0.333 mol) was placed in a 500-mL three-necked flask set in an oil bath. 1-Iodooctane (80 g, 0.33 mol), Hunig's base (43 g, 0.33 mol; N,N-diisopropyl ethyl amine), and 250 mL of dry dimethylformamide were added to the reaction mixture. The mixture was heated under nitrogen at 100° C. overnight, during which time the reaction went to completion. The mixture was drowned in 2 L of ice water, and the product was extracted out of the aqueous phase with ethyl acetate. The ethyl acetate layer was washed three times with salt water and dried over magnesium sulfate with Norit for 1 h. The ethyl acetate solution was filtered and concentrated to yield a yellow oil, compound I-83.

Preparation of Compound I-145 m-Hydroxy benzoic acid (51.5 g, 0.373 mol) was placed in a 500-mL three-necked flask set in an oil bath. 1-Iododecane (100 g, 0.373 mol), Hunig's base (48.2 g, 0.373 mol; N,N-diisopropyl ethyl amine), and 250 mL of dry dimethylformamide were added to the reaction mixture. The mixture was heated under nitrogen at 100° C. overnight, during which time the reaction went to completion. The mixture was drowned in 2 L of ice water, and the product was extracted out of the aqueous phase with methylene chloride. The methylene chloride solution was washed twice with dilute sodium bicarbonate solution and dried over magnesium sulfate. This solution was concentrated to a dark oil, which was then chromatographed on a silica gel column, and eluted with ethyl acetate/ligroin 950 (30%/70%). The desired product, compound I-145, was obtained as a yellow oil after concentration. Upon standing, this oil crystallized to a solid to give a material melting in the range of 43–44° C.

These compounds were dispersed and coated as thermal solvents as described in Examples 6 to 10. The corresponding dye transfer results are shown below in Table VII. The comparison compound, m-toluamide, is essentially ineffective in facilitating dye transfer through the test gelatin interlayer. The compounds of this invention, the other hand, provide such facilitated dye diffusion, and as illustrated in Table VII, most of these examples provide greater transfer through the test interlayer (14) than is obtained in the absence of an interlayer (Example 14).

TABLE VII

| Example | Test Compound | $D_{max}$ |
|---|---|---|
| 14 | none (no gelatin interlayer) | 0.39 |
| 15 | m-Toluamide (comparison) | 0.08 |
| 16 | Compound I-1 (this invenfion) | 0.26 |
| 17 | Compound I-27 (this invention) | 0.40 |
| 18 | Compound I-66 (this invention) | 1.16 |
| 19 | Compound I-83 (this invention) | 0.88 |
| 20 | Compound I-135 (this invention) | 1.21 |
| 21 | Compound I-145 (this invention) | 0.94 |
| 22 | Compound I-181 (this invention) | 0.38 |
| 23 | Compound II-49 (this invention) | 0.84 |

The invention has been described in detail with particular reference to preferred embodiments thereof, but it will be understood that variations and modifications can be effected within the spirit and scope of the invention.

What is claimed is:

1. An aqueous developable chromogenic photographic element for non-aqueous thermal dye-diffusion transfer comprising radiation sensitive silver halide, a dye-forming compound wherein said compound forms a heat transferable dye upon reaction of said compound with the oxidation product of a primary amine developing agent, a hydrophilic binder, and a thermal solvent for facilitating non-aqueous thermal dye diffusion transfer wherein said thermal solvent has the structure I (I)

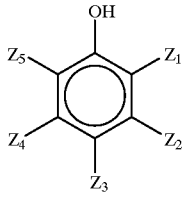

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10;

with the proviso that said heat transferable dye formed upon reaction of said compound with the oxidation product of a primary amine developing agnt transfers at a temperature of from about 50° C. to 200° C.

2. The element of claim 1, wherein said element further comprises a dye-receiving layers.

3. The element of claim 1, wherein the total of said binder amounts to from 0.2 to 20 g/m$^2$ of said element.

4. The element of claim 1, wherein said hydrophilic binder is gelatin.

5. The element of claim 1, wherein the amount of thermal solvent incorporated in a given layer is 1 to 300% by weight of the total amount of hydrophilic binder present in said layer.

6. The element of claim 1, wherein the amount of thermal solvent incorporated in a given layer is 50 to 120% by weight of the total amount of hydrophilic binder present in said layer.

7. The element of claim 1, wherein the thermal solvents comprise 3-hydroxy benzoic acid esters.

8. The element of claim 7, wherein the esters comprise aryl and alkyl esters of 3-hydroxy benzoic acid and where the aryl and alkyl groups comprise 1-hexyl, cyclohexyl, phenyl, cyclopentylmethyl, 2-hexyl, 3-hexyl, 2-ethyl-1-butyl, 3,3-dimethyl-2-butyl, 2-methyl-1-pentyl, 2-methyl-2-pentyl, 3-methyl-1-pentyl, 4-methyl-2-pentyl, 4-methyl-1-pentyl, 1-heptyl, benzyl, tolyl, 2-methyl-1-phenyl, 3-methyl-1-phenyl, 2,2-dimethyl-3-pentyl, 2,3-dimethyl-3-pentyl, 3-ethyl-2-pentyl, 3-ethyl-3-pentyl, 2-heptyl, 2-methyl-2-hexyl, 3-methyl-2-hexyl, 5-methyl-2-hexyl, 2-methyl-5-hexyl, cycloheptyl, 2-methyl-1-cyclohexyl, 3-methyl-1-cyclohexyl, 4-methyl-1-cyclohexyl, hexahydrolenzyl, 2-ethyl-1-octyl, 1-octyl, 2,2-dimethyl-3-hexyl 2,3-dimethyl-2-hexyl, 3-ethyl-3-hexyl, 2,4-dimethyl-3-hexyl, 3,4-dimethyl-2-hexyl, 3,5-dimethyl-3-hexyl, 2-methyl -2-heptyl, 3-methyl-5-heptyl, 4-methyl-4heptyl, 6-methyl-2-heptyl, 2,4,4-methyl-2-pentyl, cyclohexylethyl, cycloheptyl-methyl, 3,5-dimethyl-1-cyclohexyl, 2,6-dimethyl-1-cyclohexyl, 1-nonyl, 2-nonyl, 3-nonyl, 4-nonyl, 5-nonyl, 2-methyl-3-octyl, 2-methyl-4-octyl, 3-methyl-3-octyl, 4-methyl-4-octyl, 4-methyl-4heptyl, 2,4-dimethyl-3-heptyl, 2,6-dimethyl-4-heptyl 1,3-diisobutyl-2-propyl, 2,2,3-trimethyl-3-hexyl, 3,5,5-trimethyl-1-hexyl, 3-cyclohexyl-1-propyl, 1-methyl-1-cyclooctyl, 3,3,5-trimethylcyclohexyl, 1-decyl, 2-decyl, 3-decyl, 4-decyl, 5-decyl, 2,2-dimethyl-3-octyl, 4,7-dimethyl-4-octyl, 2,5-dimethyl-5-octyl, 3,7-dimethyl-1-octyl, 3,7-dimethyl-3-octyl, 1-undecyl, 2-undecyl, 5-undecyl, 6-undecyl, 1-dodecyl, 2-dodecyl, 2-butyl-1-octyl, 2,6,8-trimtheyl-4-nonlyl, cyclododecyl, 1-tridecyl, 1-hexadecyl, 2-hexadecyl, 2-hexyl-1-decyl, or mixtures thereof.

9. The element of claim 1, wherein the thermal solvents comprise 4-hydroxy benzoic acid esters.

10. The element of claim 9, wherein the esters comprise aryl and alkyl esters of 4-hydroxy enzoic acid and where the aryl and alkyl groups comprise 1-hexyl, cyclohexyl, phenyl, cyclopentylmethyl, 2-hexyl, 3-hexyl, 2-ethyl-1-butyl, 3,3-dimethyl-2-butyl, 2-methyl-,-pentyl, 2-inethyl-2-pentyl, 3-methyl-3-pentyl, 4-methyl-2-pentyl, 4-methyl-1-pentyl, 1-heptyl, benzyl, tolyl, 2-methyl-1-phenyl, 3-methyl-4-phenyl, 2,2-dimethyl-3-pentyl, 2,3-dimethyl-3-pentyl, 3-ethyl-2-pentyl, 3-ethyl-3-pentyl, 2-heptyl, 2-methyl-2-hexyl, 3-methyl-2-hexyl, 5-methyl-2-hexyl, 2-methyl-5-hexyl, cycloheptyl, 2-methyl-1-cyclohexyl, 3-methyl-1-cyclohexyl, 4-methyl-1-cyclohexyl, hexahydrohenzyl, 2-ethyl-1-octyl, 1-octyl, 2,2-dimethyl-3-hexyl, 2,3-dimethyl-2-hexyl, 3-ethyl-3-hexyl, 2,4-dimethyl-3-hexyl, 3,4-dimethyl-2-hexyl, 3,5-dimethyl-3-hexyl, 2-methyl-2-heptyl, 3-methyl-5-heptyl, 4-methyl-4-heptyl, 6-methyl-2-heptyl, 2,4,4-trimethyl-2-pentyl, cyclohexylethyl, cycloheptyl-methyl, 3,5-dimethyl-1-cyclohexyl, 2,6-dimethyl-1-cyclohexyl, 1-nonyl, 2-nonyl, 3-nonyl, 4-nonyl, 5-nonyl, 2-methyl-3-octyl, 2-methyl-4-octyl, 3-methyl-3-octyl, 4-methyl-4-octyl, 4-ethyl-4-heptyl, 2,4-dimethyl-3-heptyl, 2,6-dimethyl-4-heptyl, 1,3-diisobutyl-2-propyl, 2,2,3-trimethyl-3-hexyl, 3,5,5-trimethyl-1-hexyl, 3-cyclohexyl-1-propyl, 1-methyl-1-cyclooctyl, 3,3,5-trimethylcyclohexyl, 1-decyl, 2-decyl, 3-decyl, 4-decyl, 5-decyl, 2,2-dimethyl-3-octyl, 4,7-dimethyl-4-octyl, 2,5-dimethyl-5-octyl, 3,7-dimethyl-1-octyl, 3,7-dimethyl-3-octyl, 1-undecyl, 2-undecyl, 5-undecyl, 6-undecyl, 1-dodecyl, 2-dodecyl, 2-butyl-1-octyl, 2,6,8-trimethyl-4-nonyl, cyclododecyl, 1-tridecyl, 1-hexadecyl, 2-hexadecyl, 2-hexyl-1-decyl, or mixtures thereof.

11. The element of claim 1, wherein the thermal solvents comprise 3-hydroxy benzamides or 4-hydroxy benzamides.

12. The element of claim 11, wherein the amides comprise aryl and alkyl amides of 3-hydroxy benzoic acid and where the aryl and alkyl groups comprise 1-hexyl, 2-hexyl, 1-methyl-1-pentyl, cyclohexyl, 1-heptyl, 2-heptyl, 4-heptyl, 5-methyl-2-hexyl, 1,4-diemthyl-1-pentyl, cyclohexylmethyl, 2-methyl-1-cyclohexyl, 3-methyl-1-cyclohexyl, 1,1,3,3-tetramethyl-1-butyl, 1-octyl, 1-methyl-1-heptyl, 2-ethyl-2-hexyl, 2-methyl-1-heptyl, 6-methyl-2-heptyl, cyclooctyl, 2-cyclohexyl-1-ethyl, 5-nonyl, 1-nonyl, cyclooctylmethyl, 1-decyl, 2-undecyl, 4-undecyl, 1-dodecyl, cyclododecyl, 2-tridecyl, 1-tetradecyl, or mixtures thereof.

13. The element of claim 11, wherein the anides comprise aryl and alkyl amides of 4-hydroxy benzoic acid and where the aryl and alkyl groups comprise 1-hexyl, 2-hexyl, 1-methyl-1-pentyl, cyclohexyl, 1-heptyl, 2-heptyl, 4-heptyl, 5-methyl-2-hexyl, 1,4-diemthyl-1-pentyl, cyclohexylmethyl, 2-methyl-1-cyclohexyl, 3-methyl-1-cyclohexyl, 1,1,3,3-eteanethyl-1-butyl, 1-octyl, 1-methyl-1-heptyl, 2-ethyl-2-hexyl, 2-methyl-1-heptyl, 6-methyl-2-heptyl, cyclooctyl, 2-cyclohexyl-1-ethyl, 5-nonyl, 1-nonyl, cyclooctylmethyl, 1-decyl, 2-undecyl, 4-undecyl, 1-dodecyl, cyclododecyl, 2-tridecyl, 1-tetradecyl, or mixtures thereof.

14. The element of claim 1, wherein the calculated logP for I is greater than 4.5 and less than 8.

15. The element of claim 1, wherein the sum of the Hammet sigma parameters $Z_2$, $Z_3$, and $Z_4$, Σ, is in the range 0.35 to 0.90.

16. The element of claim 1, wherein the thermal solvents comprise 3,4,5-tri-hydroxy-2'-ethyl-1'-hexyl benzoate, 3,4,5-trihydroxy-1'-octyl benzoate, 3,4,5-trihydroxy-2',2'-dimethyl-3'-hexyl benzoate, 3,4,5-trihydroxy-1'-nonyl benzoate, 3,4,5-trihydroxy-1'-decyl benzoate, 1,8-octyl-bis(4'-hydroxy benzoate), 1,8-octyl-bis(3'-hydroxy benzoate), 1,10-decyl-bis(4'-hydroxy benzoate), 1,10-decyl-bis(3'-hydroxy benzoate), 3,7-dimethyl-1,7-octyl-bis(4'-hydroxy benzoate), 1,11-undecyl-bis(4'-hydroxy benzoate), 1,12-dodecyl-bis(4'-hydroxy benzoate), 1,12-dodecyl-bis(3'-hydroxy benzoate), 1,8-octyl-bis(4'-hydroxy benzamide), 1,8-octyl-bis(3'-hydroxy benzamide), 1,4-cyclohexane-bis(methyl-4'-hydroxy benzamide), 1,4-cyclohexane-bis(methyl-3'-hydroxy benzamide), 1-(methyl-4'-hydroxy benzamide)-4-(methyl-3'-hydroxy benzamide)-cyclohexane, 1,9-nonyl-bis(4'-hydroxy benzamide), 1,10-decyl-bis(4'-hydroxy benzamide), 1,10-decyl-bis(3'-hydroxy benzamide), 1,12-dodecyl-bis(4'-hydroxy benzamide), 1,12-dodecyl-bis(3'-hydroxy benzamide), 3,4-dichloro-5-(1'-heptyl) phenol, 3,4-dichloro-5-(1'-octyl) phenol, 3,4-dichloro-5-(2'-ethyl-1'-hexyl) phenol, 3,4-dichloro-5-(1'-nonyl) phenol, 3,4-dichloro-5-(1'-decyl) phenyl, 3,4-dichloro-5-(1'-dodecyl) phenol, 5-hydroxy-di-(1'-hexyl) isophthalate, 5-bydroxy-di-(1'-heptyl) isophthalate, 5-hydroxy-di-(1'-octyl) isophtbalate, 5-hydroxy-di-(2'-ethyl-1'-hexyl) isophthalate, 5-hydroxy-di-(1'-nonyl) isophthalate, 5-hydroxy-di-(1'-decyl) isophthalate, 5-hydroxy-di-(1'-undecyl) isophthalate, 5-hydroxy-di-(1'-dodecyl) isophthalate, or mixtures thereof.

17. A multilayer aqueous-developable color-photographic material for non-aqueous thermal dye-diffusion transfer comprising a support, a yellow dye producing layer containing light-sensitive silver halide grains, a compound providing a heat transferable yellow dye, and a hydrophilic binder, a magenta dye producing layer containing light-sensitive silver halide grains, a compound providing a heat transferable magenta dye, and a hydrophilic binder, a cyan dye producing layer containing light-sensitive silver halide grains, a compound providing a heat transferable cyan dye, and a hydrophilic binder, and where said material contains a thermal solvent for facilitating non-aqueous thermal dye diffusion transfer, according to formula I, (I)

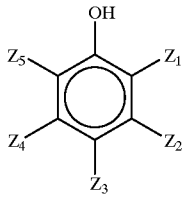

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10;

with the proviso that said heat transferable yellow, magnta, and cyan dyes formed upon reaction of said compounds with the oxidation product of a primary amine developing agent transfer at a temperature of from about 50° C. to 200° C.

18. The material of claim 17, wherein said material further comprises a dye-receiving layer.

19. The material of claim 17, wherein the total of said binder amounts to from 0.2 to 20 g/m of said material.

20. The material of claims 17, wherein said hydrophilic binder is gelatin.

21. The material of claim 17, wherein the amount of thermal solvent incorporated in a given layer is 1 to 300% by weight of the total amount of binder present in said layer.

22. The material of claim 17, wherein the amount of thermal solvent incorporated in a given layer is 50 to 120% by weight of the total amount of binder present in said layer.

23. The material of claim 17, wherein the thermal solvents comprise 3-hydroxy benzoic acid esters.

24. The material of claim 23 wherein the esters comprise aryl and aLkyl esters of 3-hydroxy benzoic acid and where the aryl and aikyl groups comprise 1-hexyl, cyclohexyl, phenyl, cyclopentylmethyl, 2-hexyl, 3-hexyl, 2-ethyl-1-butyl, 3,3-dimethyl-2-butyl, 2-methyl-1-pentyl, 2-methyl-2-pentyl, 3-methyl-1-pentyl, 4-methyl-2-pentyl, 4-methyl-1-pentyl, 1-heptyl, benzyl, tolyl, 2-methyl-1-phenyl, 3-methyl-1-phenyl, 2,2-dimethyl-3-pentyl, 2,3-dimethyl-3-pentyl, 3-ethyl-2-pentyl, 3-ethyl-3-pentyl, 2-heptyl, 2-methyl-2-hexyl, 3-methyl-2-hexyl, 5-methyl-2-hexyl, 2-methyl-5-hexyl, cycloheptyl, 2-methyl-1-cyclohexyl, 3-methyl-1-cyclohexyl, 4-methyl-1-cyclohexyl, hexahydrobenzyl, 2-ethyl-1-octyl, 1-octyl, 2,2-dimethyl-3-hexyl, 2,3-dimethyl-2-hexyl, 3-ethyl-3-hexyl, 2,4-dimethyl-3-hexyl, 3,4-dimethyl-2-hexyl, 3,5-dimethyl-3-hexyl, 2-methyl-2-heptyl, 3-methyl-5-heptyl, 4-methyl-4-heptyl, 6-methyl-2-heptyl, 2,4,4-trimethyl-2-pentyl, cyclo-hexylethyl, cycloheptyl-methyl, 3,5-dimethyl-1-cyclohexyl, 2,6-dimethyl-1-cyclohexyl, 1-nonyl, 2-nonyl, 3-nonyl, 4-nonyl, 5-nonyl, 2-methyl-3-octyl, 2-methyl-4-octyl, 3-methyl-3-octyl, 4-methyl-4-octyl, 4-ethyl-4-heptyl, 2,4-dimethyl-3-heptyl, 2,6-dimethyl-4-heptyl 1,3-diisobutyl-2-propyl, 2,2,3-trimethyl-3-hexyl, 3,5,5-trimethyl-1-hexyl, 3-cyclo-hexyl-1-propyl, 1-methyl-1-cyclooctyl, 3,3,5-trimethylcyclohexyl, 1-decyl, 2-decyl, 3-decyl, 4-decyl, 5-decyl, 2,2-dimethyl-3-octyl, 4,7-dimethyl-4-octyl, 2,5-dimethyl-5-octyl, 3,7-dimethyl-1-octyl, 3,7-dimethyl-3-octyl, 1-undecyl, 2-undecyl, 5-undecyl, 6-undecyl, 1-dodecyl, 2-dodecyl, 2-butyl-1-octyl, 2,6,8-trimethyl-4-nonyl, cyclododecyl, 1-tridecyl, 1-hexadecyl, 2-hexadecyl, 2-hexyl-1-decyl, or mixtures thereof.

25. The material of claim 17, wherein the thermal solvents comprise 4-hydroxy benzoic acid esters.

26. The material of claim 25, wherein the esters comprise aryl and alkyl estersof 4-hydroxy benzoic acid and where the aryl and alkyl groups comprise 1-hexyl, cyclohexyl, phenyl, cyclopentylmethyl, 2-hexyl, 3-hexyl, 2-ethyl-1-butyl, 3,3-dimethyl-2-butyl, 2-methyl-1-pentyl, 2-methyl-2-pentyl, 3-methyl-1-penty, 4-methyl-2-pentyl, 4-methyl-1-pentyl, 1-heptyl, benzyl, tolyl, 2-methyl-1-phenyl, 3-methyl-1-phenyl, 2,2-dimethyl-3-pentyl, 2,3-dimethyl-3-pentyl, 3-ethyl-2-pentyl, 3-ethyl-3-pentyl, 2-heptyl, 2-methyl-2-hexyl, 3-methyl-2-hexyl, 5-methyl-2-hexyl, 2-methyl-5-hexyl, cycloheptyl, 2-methyl-1-cyclohexyl, 3-methyl-1-cyclohexyl, 4-methyl-i -cyclohexyl, hexahydrobenzyl, 2-ethyl-1-octyl, 1-octyl, 2,2-methyl-3-hexyl, 2,3-dimethyl-2-hexyl, 3-ethyl-3-hexyl, 2,4-dimethyl-3-hexyl, 3,4-dimethyl-2-hexyl, 3,5-dimethyl-3-hexyl, 2-methyl-2-heptyl, 3-methyl-5-heptyl, 4-methyl-4-heptyl, 6-methyl-2-heptyl, 2,4,4-trimethyl-2-pentyl, cyclo-hexylethyl, cycloheptyl-methyl, 3,5-dimethyl-1-cyclohexyl, 2,6-dimethyl-1-cyclohexyl, 1-nonyl, 2-nonyl, 3-nonyl, 4-nonyl, 5-nonyl, 2-methyl-3-octyl, 2-methyl-4-octyl, 3-methyl-3-octyl, 4-methyl-4-octyl, 4-ethyl-4-heptyl, 2,4-dimethyl-3-heptyl, 2,6-dimethyl-4-heptyl, 1,3-diisobutyl-2-propyl, 2,2,3-trimethyl-3-hexyl, 3,5,5-trimethyl-1-hexyl, 3-cyclo-hexyl-1propyl, 1-methyl-1-cyclooctyl, 3,3,5-trimethylcyclohexyl, 1-decyl, 2-decyl, 3-decyl, 4-decyl, 5-decyl, 2,2-dimethyl-3-octyl, 4,7-dimethyl-4-octyl, 2,5-dimethyl-5-octyl, 3,7-dimethyl-1-octyl, 3,7-dimethyl-3-octyl, 1-undecyl, 2-undecyl, 5-undecyl, 6-undecyl, 1-dodecyl, 2-dodecyl, 2-butyl-1-octyl, 2,6,8-trimethyl-4-nonyl, cyclo-dodecyl, 1-tridecyl, 1-hexadecyl, 2-hexadecyl, 2-hexyl-1-decyl, or mixtures thereof.

27. The material of claim 17, wherein the thermal solvents comprise 3-hydroxy benzamides or 4-hydroxy benzamides.

28. The material of claim 27, wherein the amides comprise aryl and alkyl amides of 3-hydroxy benzoic acid and where the aryl and alkyl groups comprise 1-hexyl, 2-hexyl, 1-methyl-1-pentyl, cyclohexyl, 1-heptyl, 2-heptyl, 4-heptyl, 5-methyl-2-hexyl, 1,4-diemthyl-1-pentyl, cyclo-hexylmethyl, 2-methyl-1-cyclohexyl, 3-methyl-1-cyclohexyl, 1,1,3,3-etramethyl-1-butyl, 1-octyl, 1-methyl-1-heptyl, 2-ethyl-2-hexyl, 2-methyl-1-heptyl, 6-ethyl-2-heptyl, cyclooctyl, 2-cyclohexyl-2-ethyl, 5-nonyl, 1-nonyl, cyclooctylmethyl, 1-decyl, 2-undecyl, 4-undecyl, 1-dodecyl, cyclododecyl, 2-tridecyl, 1-tetradecyl, or mixtures thereof.

29. The material of claim 27, wherein the amides comprise aryl and alkyl amides of 4-hydroxy benzoic acid and where the aryl and alkyl groups comprise 1-hexyl, 2-hexyl, 1-methyl-1-pentyl, cyclohexyl, 1-heptyl, 2-heptyl, 4-heptyl, 5-methyl-2-hexyl, 1,5-diemthyl-1-pentyl, cyclo-hexylmethyl, 2-methyl-1-cyclohexyl, 3-methyl-1-cyclohexyl, 1,1,3,3-tetramethyl-1-butyl, 1-octyl, 1-methyl-1-heptyl, 2-ethyl-2-hexyl, 2-methyl-1-heptyl, 6-methyl-2-heptyl, cyclooctyl, 2-cyclohexyl-1-ethyl, 5-nonyl, 1-nonyl, cyclooctylmethyl, 1-decyl, 2-undecyl, 4-undecyl, 1-dodecyl, cyclododecyl, 2-tridecyl, and 1-tetradecyl, or mixtures thereof.

30. The material of claim 17, wherein the sum of the Hammet sigma parameters $Z_2$, $Z_3$, and $Z_4$, $\Sigma$, is in the range 0.35 to 0.90.

31. The material of claim 17, wherein the calculated logP for I is greater than 4.5 and less than 8.

32. The material of claim 17, wherein the thermal solvents comprise 3,4,5-trihydroxy-2'-ethyl-1'-hexyl benzoate, 3,4,5-trihydroxy-1'-octyl benzoate, 3,4,5-trihydroxy-2',2'-dimethyl-3'-hexyl benzoate, 3,4,5-trihydroxy-1'-nonyl benzoate, 3,4,5-trihydroxy-1'-decyl benzoate, 1,8-octyl-bis (4'-hydroxy benzoate), 1,8-octyl-bis(3'-hydroxy benzoate), 1,10-decyl-bis(4'-hydroxy benzoate), 1,10-decyl-bis(3'-hydroxy benzoate), 3,7-dimethyl-1,7-octyl-bis(4'-hydroxy benzoate), 1,1-undecyl-bis(4'-hydroxy benzoate), 1,12-dodecyl-bis(4'-hydroxy benzoate), 1,12-dodecyl-bis(3'-hydroxy benzoate), 1,8-otyl-bis(4'-hydroxy benzamide), 1,8-octyl-bis(3'-hydroxy benzamide), 1,4-cyclohexane-bis (methyl-4'-hydroxy benzamide), 1,4-cyclohexane-bis (methyl-3'-hydroxy benzamide), 1-(methyl-4'-hydroxy benzamide)-4-(methyl-3"-hydroxy benzamide)-cyclohexane, 1,9-nonyl-bis(4'-hydroxy benzamide), 1,10-decyl-bis(4'-hydroxy benzamide), 1,10-decyl-bis(3'-hydroxy benzamide), 1,12-dodecyl-bis(4'-hydroxy benzamide), 1,12-dodecyl-bis(3'-hydroxy benzamide), 3,4-dichloro-5-(1'-heptyl) phenol, 3,4-dichloro-5-(1'-octyl) phenol, 3,4-dichloro-5-(2'-ethyl-1'-hexyl) phenol, 3,4-dichloro-5-(1'-nonyl) phenol, 3,4-dichloro-5-(1'-decyl) phenol, 3,4-dichloro-5-(1'-dodecyl) phenol, 5-hydroxy-di-(1'-hexyl) isophthalate, 5-hydroxy-di-(1'-heptyl) isophthalate, 5-hydroxy-di-(1'-octyl) isophthalate, 5-hydroxy-di-(2'-ethyl-1'-hexyl) isophthalate, 5-hydroxy-di-(1'-nonyl) isophthalate, 5-hydroxy-di-(1'-decyl) isophthalate, 5-hydroxy-di-(1'-undecyl) isophthalate, 5-hydroxy-di-(1'-dodecyl) isophthalate, or mixtures thereof.

33. The material of claim 17, wherein the binder comprises gelatin, polyvinylalcohol, and polypyrrolidone.

34. The material of claim 17, wherein the dye providing compounds comprise indoaniline dye providing compounds.

35. The material of claim 17, wherein the dye providing compounds comprise indoaniline dye providing couplers which are formed upon reaction with an oxidized primary amine developing agent.

* * * * *